US009714568B2

(12) United States Patent
Rendusara et al.

(10) Patent No.: US 9,714,568 B2
(45) Date of Patent: Jul. 25, 2017

(54) EVENT-BASED TELEMETRY FOR ARTIFICIAL LIFT IN WELLS

(71) Applicant: Schlumberger Technology Corporation, Sugar Land, TX (US)

(72) Inventors: Dudi Abdullah Rendusara, Singapore (SG); Luis Parra, Houston, TX (US); Adrian Ronald Francis, Austin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/035,710

(22) PCT Filed: Nov. 11, 2014

(86) PCT No.: PCT/US2014/065013
§ 371 (c)(1),
(2) Date: May 10, 2016

(87) PCT Pub. No.: WO2015/073433
PCT Pub. Date: May 21, 2015

(65) Prior Publication Data

US 2016/0290126 A1 Oct. 6, 2016

Related U.S. Application Data

(60) Provisional application No. 61/903,889, filed on Nov. 13, 2013.

(51) Int. Cl.
*G01V 3/00* (2006.01)
*E21B 47/12* (2012.01)
(Continued)

(52) U.S. Cl.
CPC ..... *E21B 47/122* (2013.01); *E21B 43/128* (2013.01); *E21B 47/0007* (2013.01); *E21B 47/12* (2013.01)

(58) Field of Classification Search
CPC .. E21B 47/122; E21B 43/128; E21B 47/0007; E21B 47/12
(Continued)

(56) References Cited

U.S. PATENT DOCUMENTS 8,527,219 B2 9/2013 Camilleri
2002/0101826 A1 8/2002 Giacopelli et al.
(Continued)

FOREIGN PATENT DOCUMENTS

CN 101260804 5/2013
WO 2005022757 A2 3/2005
WO 2008150811 A1 12/2008

OTHER PUBLICATIONS

PCT/US2014/065013, International Search Report and Written Opinion, dated Apr. 28, 2015, 16 pgs.
(Continued)

*Primary Examiner* — Dhaval Patel
(74) *Attorney, Agent, or Firm* — Michael Stonebrook

(57) ABSTRACT

Event-based telemetry for artificial lift in wells is described. An example downhole system can sense triggering events and anomalies in a well or electrical submersible pump (ESP) string, and send information about the triggering event with priority to a monitoring and control system. A telemetry manager can select specific sensors to address the triggering event, and then determine how frequently the selected sensors acquire or sample sensor data. The telemetry manager may then assemble a data stream that prioritizes the sensor data for transmission on limited bandwidth, thereby sending the most important data about the triggering
(Continued)

event with the highest priority, even when there is limited transmission bandwidth available.

19 Claims, 10 Drawing Sheets

(51) Int. Cl.
*E21B 47/00* (2012.01)
*E21B 43/12* (2006.01)

(58) Field of Classification Search
USPC ..... 340/853.1, 854.6, 5.61, 854.3, 853.2, 340/853.7, 855.7; 370/390, 252; 702/6, 702/11, 45
See application file for complete search history.

(56) References Cited

U.S. PATENT DOCUMENTS

| | | | | |
|---|---|---|---|---|
| 2006/0256718 | A1* | 11/2006 | Hall | H04L 5/14 370/230 |
| 2007/0057811 | A1* | 3/2007 | Mehta | G01V 11/002 340/853.3 |
| 2013/0090853 | A1 | 4/2013 | Anderson | |
| 2013/0272898 | A1 | 10/2013 | Toh et al. | |

OTHER PUBLICATIONS

International Preliminary Report on Patentability issued in related PCT application PCT/US2014/065013 on May 26, 2016, 13 pages.

* cited by examiner

106

108

EVENT TABLE 114

| | | | | |
|---|---|---|---|---|
| FLOW RATE | 1500 < | 2200 | > 2500 | BBL/DAY |
| WATER CUT | 20 < | 40 | > 45 | % |
| GAS OIL RATIO | 110 < | 600 | > 800 | $FT^3$/BBL |
| CASING PRESSURE | 75 < | 100 | > 150 | PSI |
| FREE GAS AT INTAKE | 0 < | 0 | > 10 | % |
| MOTOR TEMP | 50 < | 75 | > 204° | C |
| OPERATING FREQUENCY | 30 < | 45 | > 65 | HZ |
| BOTTOM HOLE PRESSURE | 200 < | 760 | > 1000 | PSI |
| OIL RATE | 1000 < | 1320 | > 1800 | BBL/DAY |
| WATER RATE | 300 < | 879 | > 950 | BBL/DAY |
| TOTAL FLOW RATE | 750 < | 2200 | > 3500 | BBL/DAY |
| OIL GRAVITY | 10 < | 15 | > 20 | API |
| WELLHEAD PRESSURE | 100 < | 165 | > 500 | PSI |
| WELLHEAD TEMP | 30 < | 49 | > 100° | C |
| DISCHARGE PRESSURE | 1000 < | 1400 | > 2000 | PSI |
| DISCHARGE TEMP | 50 < | 79 | > 150° | C |
| INTAKE PRESSURE | 250 < | 525 | > 800 | PSI |
| INTAKE TEMP | 30 < | 74 | > 150° | C |
| MOTOR CURRENT | 10 < | 39.5 | > 80 | AMPS |
| MOTOR VOLTAGE | 1000 < | 2305 | > 4000 | VOLTS |
| MOTOR VIBRATION | 0.01 < | 0.05 | > 0.1 | GS |
| RESERVOIR PRESSURE | 1000 < | 1350 | > 1500 | PSI |
| RESERVOIR TEMP | 50 < | 77 | > 100° | C |

⋮

FIG. 7

EVENT-BASED TELEMETRY FOR ARTIFICIAL LIFT IN WELLS

RELATED APPLICATIONS

This patent application claims the benefit of priority to U.S. Provisional Patent Application No. 61/903,889 to Rendusara et al., filed Nov. 13, 2013, and incorporated herein by reference in its entirety.

BACKGROUND

In conventional monitoring systems for artificial lift, including those with electric submersible pumps (ESPs), data transmission rates from well to a data collection point or supervisory entity can be very limited. For example, some downhole monitoring gauge systems transmit at approximately 12.5 bits per second (bps). Other conventional systems transmit at approximately 100 bits per second. The limited transmission bandwidth is sometimes desirable, for economy. Even with a 100 bps transmission rate, however, the bandwidth is not great enough to transmit all the gauge and sensor information available during an urgent event without imposing delays, which may slow down intervention measures and compromise the longevity of the artificial lift system. Limiting information during an unexpected event can be a bottleneck that affects performance and production, and can result in expensive repairs that could have been avoided with quick intervention. Some monitoring systems even waste the available limited bandwidth during a crisis.

SUMMARY

In an event-based telemetry system for artificial lift in wells, an example process includes receiving sensor data related to parameters of a well, transmitting the sensor data to a supervisory entity, detecting a triggering event associated with the well based on the sensor data, assigning a high priority to a datum related to the triggering event, and transmitting the datum to the supervisory entity with a higher priority than the routine sensor data. A telemetry management module includes a polling engine for gathering data from sensors associated with a well, an event table for determining a trigger event associated with the well based on the data, and a priority engine for transmitting data associated with the trigger event at a higher priority than data from the sensors not associated with the trigger event. An example system includes sensors associated with a well for generating data related to well parameters, a polling engine for gathering the data from the sensors at intervals, a database for identifying a triggering event associated with the well based on the data, and a priority engine for transmitting a datum related to the triggering event with a higher priority than data not related to the triggering event.

This summary is not intended to identify key or essential features of the claimed subject matter, nor is it intended to be used as an aid in limiting the scope of the claimed subject matter.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

FIG. 7 is a diagram of an example event table for determining the occurrence of a triggering event in an ESP string.

DETAILED DESCRIPTION

Overview

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

This disclosure describes event-based telemetry for artificial lift. Conventional telemetry systems, used in rugged downhole environments, may have limited bandwidth, with transmission rates on the order of about 12.5 bits-per-second (bps). Bandwidth as used herein, means the rate of data transfer, bit rate, or throughput, measured in bits per second (bps). Emerging state-of-the-art systems may offer higher transmission rates that approach 100 bps. However, even this rate is inadequate to transmit the large quantity of available downhole sensor data. Thus, with such conventional telemetry systems, choices must be made as to which of the available data is to be monitored, how frequently it is to be acquired/sampled, and with what priority it is to be transmitted to the control and monitoring equipment.

Conventional systems that monitor operating parameters according to a constant protocol or constant data sampling may waste bandwidth, since the same operational data values may be sent over and over again, even when there is no change in the corresponding operational parameter.

The conventional telemetry channels for artificial lift may adopt a reduced data bandwidth intentionally, for ongoing economy. Deep wells may have to send sensor data a long distance to the surface, over limited hardwiring that may be several kilometers in length, so downhole bandwidth may be at a premium. Moreover, wells in remote geographical locations may have to pay a subscription rate to send data to a headquarters, for example, by satellite. Since most of the time the sensor data to be transmitted is routine and repetitive, a limited transmission bandwidth provides a good cost-benefit tradeoff. During an urgent downhole event, however, the limited transmission bandwidth may be insufficient to provide an understanding of the event, including its causes and effects, in time to make a meaningful intervention.

Example systems described herein prioritize the acquisition of sensor data with respect to a well event that is occurring or has recently occurred, and then prioritize the transmission of the most important collected data and make efficient use of available transmission bandwidth.

Example Systems

Figure 1:
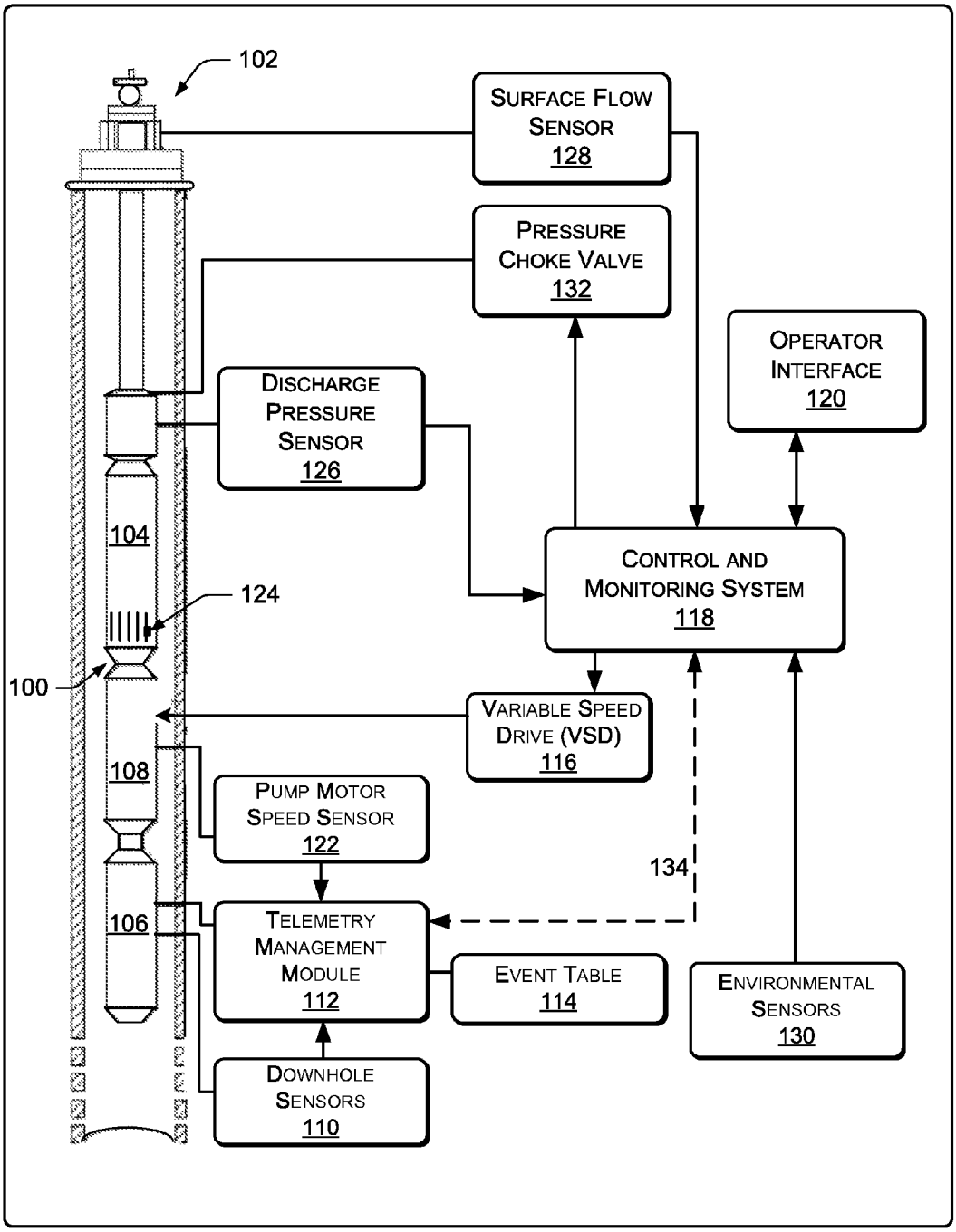
FIG. 1 is a block diagram of an example ESP system using event-based telemetry, including an example telemetry management module.

FIG. 1 shows an example electric submersible pump (ESP) system 100 deployed as part of a wellbore completion 102. The example ESP system 100 incorporates an ESP string, which may include at least one pump 104, at least one motor 106, at least one motor protector 108, and various sensors, including downhole sensors 110, gauges, multisensory gauges, etc., disposed in the wellbore. A typical well system having an ESP string 100, intake and discharge pressure gauges, switchgear and an integrated surface panel for control and monitoring of the ESP and downhole operating parameters via wireline is described in U.S. Pat. No. 8,527,219, which is incorporated by reference herein in its entirety.

An example telemetry management module 112 is present downhole to decide when a noteworthy or urgent event ("triggering event") occurs, based on an event table 114 that defines the triggering events. In an implementation, the example telemetry management module 112 prioritizes the acquisition of sensor data based on the triggering event, and can prioritize transmission of the collected data to send the most important information with priority and make efficient use of available limited transmission bandwidth.

The motor 106 may be controlled with a variable speed drive (VSD) 116 on the surface, such as that described in U.S. Pat. No. 8,527,219, which may provide a variable frequency signal to the motor 106 to increase or decrease the motor speed.

A control and monitoring system 118 may also be in electrical communication, e.g., via wireline, with the ESP 100, the telemetry management module 112, and the downhole sensors 110. The control and monitoring system 118 may incorporate supervisory control and data acquisition (SCADA) hardware and modules and may enable the control of downhole components and the routine monitoring of various downhole parameters, such as temperature, flow and pressure. An example SCADA layout, and other industrial control systems, are described in U.S. Patent Pub. No. 20130090853, incorporated herein by reference in its entirety.

The control and monitoring system 118 may include an operator's user interface 120. The control and monitoring system 118 incorporates one or more processing units or programmable logic controllers (PLCs) for executing software application instructions and storing and retrieving data from memory, and may continuously process input signals from the downhole sensors 110, at least one pump motor speed sensor 122, at least one input pressure sensor 124, discharge pressure sensor 126, surface flow sensor 128, environmental sensors 130, and other sensors to be described in FIGS. 3-6. The control and monitoring system 118 may output control signals to the variable speed drive (VSD) 116, and other control hardware, such as one or more pressure choke valves 132.

Although illustrated schematically, the output signals from the various downhole sensors 110 may be conveyed by the telemetry management module 112 to the control and monitoring system 118 via a downhole wireline, which may include telemetry link 134. The downhole sensors 110 may have their own dedicated data line, or may use "communication-over-power-line" data transfer over the power cable between the surface and the ESP motor 106. Control signals may be generated by control algorithms or applications executed by the control and monitoring system 118 to perform automated procedures on the ESP 100, including control of the pump motor 106.

At least some of the downhole sensors 110 and the example telemetry management module 112 may be hosted by, or integrated into the electronics of, a known monitoring system, such as a Phoenix Multisensor xt150 Digital Downhole Monitoring System for electric submersible pumps (Schlumberger Technology Corporation, Houston, Tex.).

A given control and monitoring system 118 that includes or hosts the example telemetry management module 112 may be SCADA-ready and have a MODBUS protocol terminal with RS232 and RS485 ports, for example, for continuous data output. A power source (not shown) may provide power to the downhole components, including the motor 106, via a power cable. Power may be provided to the sensors 110 over a wireline that is also suitable for data.

When hosted by, or cooperating with, a monitoring system, such as the Phoenix Multisensor xt150 Digital Downhole Monitoring System introduced above, the example telemetry management module 112 may be incorporated into models of the monitoring system during manufacture, or may be added to the monitoring system discretely, as a retrofit. Stock monitoring systems, such as the Phoenix Multisensor xt150 Digital Downhole Monitoring System, incorporate state-of-the-art and high-temperature microelectronics and reliable digital telemetry to communicate with a control center ("supervisory entity"), such as control and monitoring system 118 on the surface, for example, through the ESP motor cable. The electrical system of the Phoenix Multisensor xt150 Digital Downhole Monitoring System is designed to have a built-in tolerance for high phase imbalance and the capacity to handle voltage spikes.

Figure 2:
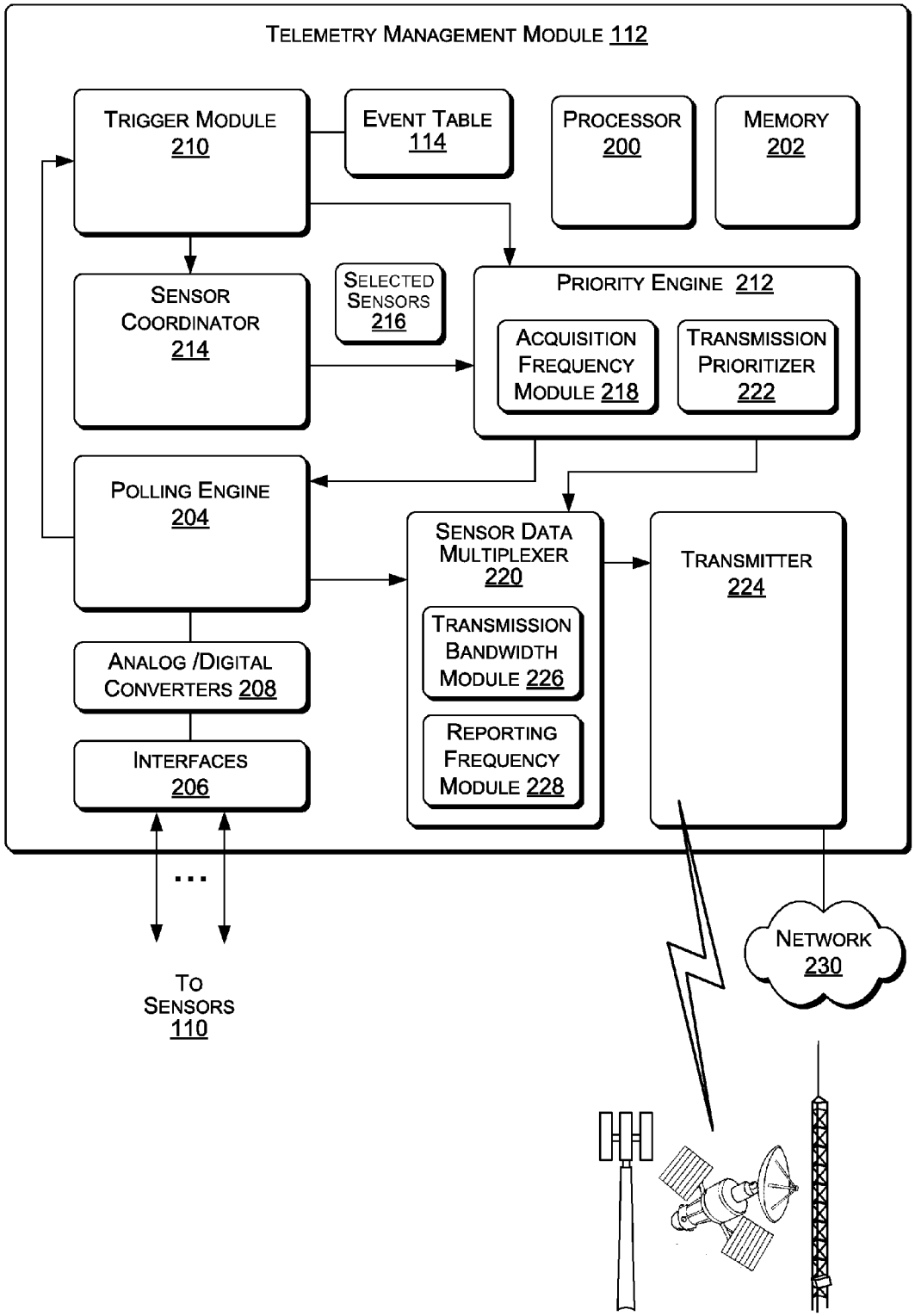
FIG. 2 is a block diagram of the example telemetry management module of FIG. 1, in greater detail.

FIG. 2 shows an example configuration of the telemetry management module 112 of FIG. 1, in greater detail. The example telemetry management module 112 may include one or more processors 200 for executing instructions and processing data received from the various downhole sensors 110 for pressure, flow, temperature, and other operational parameters. The example telemetry management module 112 may also include computer memory 202.

FIG. 2 illustrates one example configuration of the telemetry management module 112, for purposes of description, but other configurations can also be used. For example, the telemetry management module 112 may be distributed in multiple physical modules and some components, such as the transmitter 224, may even be on the surface. Moreover, the processes and operational techniques carried out by the example telemetry management module 112 may be rendered in software, firmware, logic, programming code, ARM instruction sets, and in hardware, or a combination thereof. For example, in an implementation, some of the components shown in FIG. 2 may exist as programming code in the memory 202. In an implementation, the example telemetry management module 112 may utilize some of the components of a hosting computing device or monitoring system 118 to constitute the corresponding components shown in FIG. 2 (for example, the processor 200, memory 202, interfaces 206, and transmitter 224).

In an implementation, the telemetry management module 112 includes a polling engine 204 to gather data from the downhole sensors 110 via interfaces 206, at selected time intervals. One or more analog-digital converters 208 may be associated with the interfaces 206 to change analog sensor data to digital data. A trigger module 210 receives an indication of the sensor data from the polling engine 204, and monitors the event table 114 to determine when a triggering event has occurred.

When a triggering event occurs, the trigger module 210 may signal a priority engine 212 to pass the sensor data indicating a triggering event for immediate transmission, with higher priority than all other routine sensor data available for transmission.

The trigger module 210 may also send the identity of the triggering event to a sensor coordinator 214 to build a list of selected sensors 216 to address and monitor the triggering event. The priority engine 212 receives an indication of the selected sensors 216 associated with the triggering event, and may prioritize the selected sensors 216 with respect to their relevance or importance to the triggering event. An acquisition frequency module 218 may increase or decrease the polling frequency applied by the polling engine 204 for each sensor in the selected sensors 216 associated with the triggering event. Thus, those sensors 110 in the selected sensors 216 with the highest priority may be polled more frequently for data that is relevant to the triggering event than other sensors 110 in the selected sensors 216 that have a lower assigned priority. Each sensor 110 in the selected sensors 216 may be polled with a frequency that is related to the priority assigned to that sensor 110 by the priority engine 212.

In an implementation, in addition to polling the selected sensors 216 at their assigned acquisition frequency for data relevant to the triggering event, the polling engine 204 may also continue to gather routine sensor data from downhole sensors 110 that generate data, but are not deemed by the sensor coordinator 214 to be directly relevant to the triggering event.

The data from the selected sensors 216 relevant to the triggering event and the routine sensor data compiled by the polling engine 204 may be sent to a sensor data multiplexer 220. A transmission prioritizer 222 associated with the priority engine 212 may inform the sensor data multiplexer 220 of the priority information of the selected sensors 216 for purposes of assembling a data stream to transmit over a transmitter 224 that may have limited bandwidth. A transmission bandwidth module 226, as informed by the transmission prioritizer 222, may determine the bandwidth to assign to the data from each sensor 110 in the selected sensors 216. Likewise, or in conjunction with the transmission bandwidth module 226, a reporting frequency module 228, as informed by the transmission prioritizer 222, may determine how often to transmit data from a given sensor 110 of the selected sensors 216.

The sensor data multiplexer 220 has knowledge of the amount of bandwidth available to the transmitter 224, and assembles the data stream to be transmitted accordingly, prioritizing the data most important to the triggering event with the highest priority with respect to transmission bandwidth and reporting frequency. The sensor data multiplexer 220 combines multiple digital data signals or data streams into one signal over a shared medium. The multiplexed signal is transmitted over a communication channel by the transmitter 224, which may have limited bandwidth. The multiplexing divides the capacity, throughput, or bandwidth of the communication channel into several low-level logical channels, one for each message signal or sensor data stream to be transferred. Or, the multiplexer 220 may just combine the sensor data itself into a single stream that is efficient.

In an implementation, the multiplexer 220 may use time-division multiplexing (TDM), instead of space or frequency multiplexing, to combine the data of the different selected sensors 216. TDM sequences groups of a few bits or bytes from each individual input stream, one after the other, and in such a way that they can be associated with the appropriate receiver. If more than one receiving device is used to demultiplex, then the receivers may not detect that some of the transmission time was used to serve other logical communication paths.

The transmitter 224, which may have limited bandwidth, transmits the assembled data stream uphole to the control and monitoring system 118, to a network 230, to a supervisory entity, and/or to a wireless receiver of a tower or satellite, depending on the SCADA system in use, the layout of hardware components, or the layout of remote terminal units (RTUs) for the particular well. As described above, the transmitter 224 may present a data bottleneck by sending the data stream at 12.5 or 100 bits per second.

FIGS. 3-6 show additional downhole sensors 110 that can be placed in communication with the example telemetry management module 112. These sensors are further described in U.S. Patent Application No. 20130272898 to Toh et al., incorporated herein by reference in its entirety. The additional sensors 110 may also associated with a triggering event, and their data prioritized for increased acquisition frequency and increased transmission bandwidth based on their assigned priority.

Further sensors 110 along the ESP string 100 may include distributed temperature sensors, vibration spectral data sensors, differential pressure sensors, strain sensors, proximity sensors, load cell sensors, dirty filter sensors, bearing wear sensors, positional sensors, rotational speed sensors, torque sensors, electrical leakage detectors, wye-point imbalance sensors, chemical sensors, water cut sensors, and so forth.

In an implementation, some of the multiple sensors 110 may be mounted on the production tubing either above or below the ESP 100 artificial lift equipment. The example telemetry management module 112 may collect and transmit the sensor data to the surface via an independent encapsulated instrument cable. Advanced transducer technology, state-of-the-art microelectronic components, and digital telemetry can be used to ensure that data are highly reliable and accurate. Critical measurements required for pressure transient analysis may be obtained by sampling the data every two seconds, for example.

Figure 3:
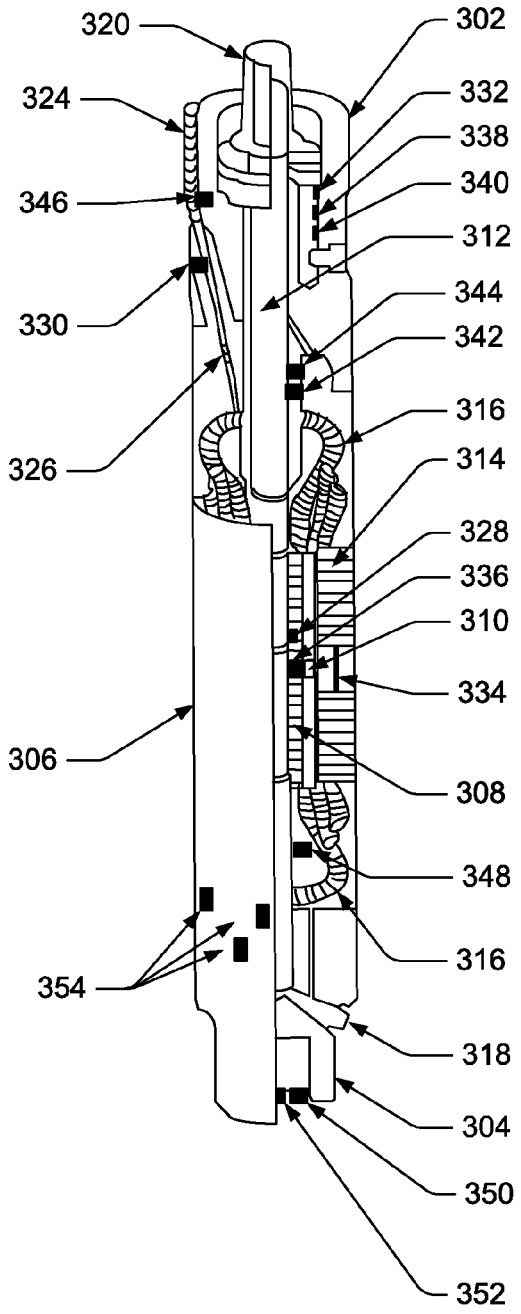
FIG. 3 is a diagram of an example ESP motor section, including sensors that can be used with event-based telemetry.

FIG. 3 shows an example ESP motor 106, which may power one or more components of the ESP string 100. For example, in one scenario, the example motor 106 may power multiple pump stages 104. The example motor 106 has various hardware components to be monitored by associated sensors 110. The example motor 106 may have a motor head 302, a motor base 304, and an outer housing 306. A rotor 308, supported by rotor bearings 310, drives rotation of a shaft 312. A stator 314 with laminations provides a rotating magnetic field to drive the rotor 308.

The stator 314 has windings 316, which create electromagnetic fields when electricity flows. The rotor 308 may also have windings 316, to induce electromagnetic fields that interact with the electromagnetic fields of the stator 314. Alternatively, the rotor 308 may have permanent magnets instead of windings 316. The motor 106 may have other features, such as a drain and fill valve 318 for motor oil, such as dielectric oil. A coupling 320 at the motor head 302 connects with a pump 104 or a protector 108. Bearings for the shaft 312 may have associated thrust members 322 or a thrust ring to bear the axial load generated by the thrust of one or more operating pumps 104. Electrically, the motor 106 may have a power cable extension 324 that connects to a terminal 326.

Various types of sensors may be included in the ESP string 100 to monitor many aspects of the above components. The rotor 308, for example, may have a rotor temperature sensor 328. There may also be a pothead temperature sensor 330. Each bearing, such as the rotor bearings or a thrust bearing 322 may have a bearing temperature sensor 332. A fiber optic strand acting as a distributed temperature sensor 334 may be place in the stator 314.

In an implementation, the example system measures distributed temperature 334 via fiber optics, and also includes vibration sensors 336 at multiple locations along the ESP string 100. For example, an example ESP system 100 may deploy distributed temperature sensing 334 and vibration sensors 336 mainly at pump bearings and rotor bearings, such as bearing 322. In an implementation, the example ESP 100 makes measurements using fiber optics that are placed internally, e.g., in the motor stator 314, or makes measurements via electronic gauges strapped to external housing points along the ESP string 100.

As well as measuring distributed temperatures 334 along its length, an optical fiber can also be used as a sensor to measure strain, pressure and other quantities by modifying the fiber so that the quantity being measured modulates the intensity, phase, polarization, wavelength, or transit time of light in the fiber. Sensors that can vary the intensity of light are the simplest to employ in an ESP string 100, since only a simple source and detector are required. An attractive feature of intrinsic fiber optic sensing is that it can provide distributed sensing over very large distances, as when a well is very deep.

Temperature can be measured by using a fiber that has evanescent loss that varies with temperature, or by analyzing the Raman scattering of the optical fiber. Electrical voltage in the ESP string 100 can be sensed by nonlinear optical effects in specially-doped fiber, which alter the polarization of light as a function of voltage or electric field. Angle measurement sensors can be based on the Sagnac effect.

Optical fiber sensors for distributed temperature sensing 334 and pressure sensing in downhole settings are well suited for this environment when temperatures are too high for semiconductor sensors.

Fiber optic sensors can be used to measure co-located temperature and strain simultaneously, e.g., in ESP bearings 322 with very high accuracy using fiber Bragg gratings. This technique is useful when acquiring information from small complex structures.

A fiber optic AC/DC voltage sensor can be used in the example ESP string 100 to sense AC/DC voltage in the middle and high voltage ranges (100-2000 volts). The sensor is deployed by inducing measurable amounts of Kerr nonlinearity in single mode optical fiber by exposing a calculated length of fiber to the external electric field. This measurement technique is based on polarimetric detection and high accuracy is achieved in hostile downhole environments.

Electrical power in the ESP string 100 can be measured in a fiber by using a structured bulk fiber ampere sensor coupled with proper signal processing in a polarimetric detection scheme.

When used as a transmission medium for signals from conventional sensors to the surface, extrinsic fiber optic sensors use an optical fiber cable, normally a multimode one, to transmit modulated light from either a non-fiber optical sensor, or an electronic sensor connected to an optical transmitter. Using a fiber to transmit data of extrinsic sensors provides the advantage that the fiber can reach places that are otherwise inaccessible. For example, a fiber can measure temperature inside a hot component of the ESP string 100 by transmitting radiation into a radiation pyrometer located outside the component. Extrinsic sensors can be used in the same way to measure the internal temperature of the submersible motor 106, where the extreme electromagnetic fields present make other measurement techniques impossible.

Fiber optic sensors provide excellent protection of measurement signals from noise corruption. However, some conventional sensors produce electrical output which must be converted into an optical signal for use with fiber. For example, in the case of a platinum resistance thermometer, the temperature changes are translated into resistance changes. The PRT can be outfitted with an electrical power supply. The modulated voltage level at the output of the PRT can then be injected into the optical fiber via a usual type of transmitter. Low-voltage power might need to be provided to the transducer, in this scenario.

Extrinsic sensors can also be used with fiber as the transmission medium to the surface to measure vibration, rotation, displacement, velocity, acceleration, torque, and twisting in the ESP string 100.

An example electronic module can sense vibrations in various planes or combinations of planes, for example the X and Z planes in a 3-dimensional space. In an implementation, vibration canceling modules 354 counteract or dampen vibrations, through vibration canceling technology applied in specific planes. In one implementation, a sensor of an example vibration module can obtain vibration spectral data up to 1 kHz for a select component along an ESP string 100, for example, for a part of a rotating motor shaft.

The example ESP system 100 can also measure temperature profiles along a power cable, e.g., from surface to ESP string 100, using fiber optics or platinum resistance temperature detector(s) (RTDs) 330, e.g., at a pothead.

A rotor vibration sensor 336 may be included to sense relative health of the rotor 308 and its bearings. Each bearing may also have a strain sensor 338 and a proximity sensor 340 to sense wear, as measured by changing alignment or changing tolerances. The rotating shaft 312 of the ESP may have an associated tachometer RPM sensor 342 and a torque sensor 344. The torque sensors 344 may be packaged around motor shafts 312 for monitoring torque and rotational power. Electrically, the ESP may have an electrical current leakage sensor 346 and a wye-point voltage or current imbalance sensor 348. The ESP may also have associated chemical sensors 350, and water cut sensors 352. Additional sensors, e.g., from Wireline Downhole Fluid Analysis tools may be employed to detect gas-oil ratios, solids content, hydrogen sulfide and carbon dioxide concentrations, pH, density, viscosity, and other chemical and physical parameters. The water cut sensors 352 may also be located at various locations in an ESP string for oil purity measurements and for detecting water ingress.

Figure 4:
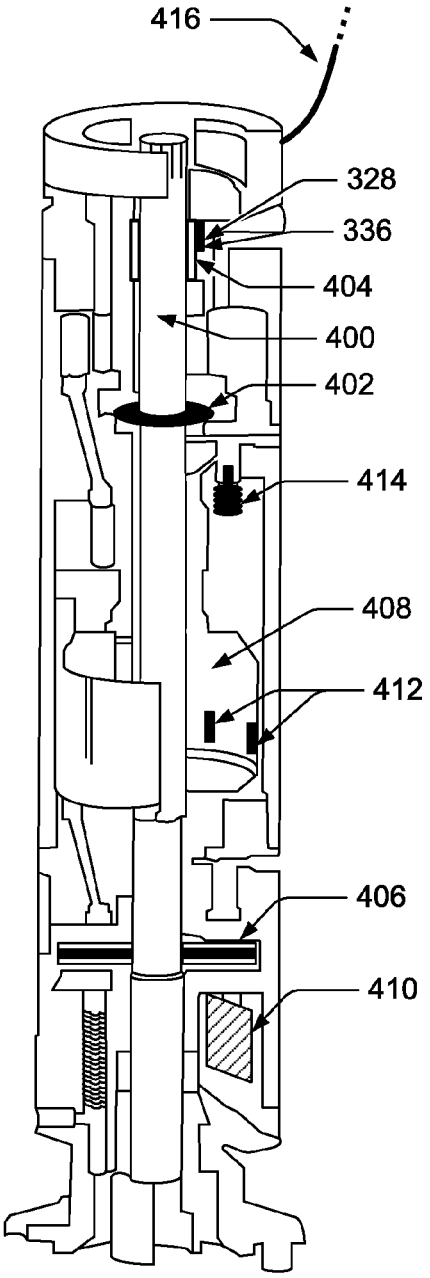
FIG. 4 is a diagram of an example ESP protector section, including sensors that can be used with event-based telemetry.

As shown in FIG. 4, the example ESP string 100 may also include an ESP protector 108, which intervenes between motor 106 and pump 104, and which has various components and associated sensors. An example protector 108 may include a shaft 400, shaft seal 402, and shaft bearing 404. At least one shaft bearing may have an associated thrust bearing 406 to bear an axial load of the shaft 400 generated by pump thrust. In an implementation, a thrust bearing is instrumented by addition of temperature, strain, and proximity sensors to monitor status. The protector 108 may also equalize pressure between the motor 106 and pump 104, such as equalization of oil expansion between the two components, or may equalize pressure between the ambient well environment and the interior of the protector 108, and may therefore include at least one expandable bag or bellows chamber 408. The protector 108 may also include a filter 410, when oil in the protector 108 is in communication with motor oil, e.g., the filter 410 keeps motor debris from the protector 108, or, in another or the same implementation, when the interior of the protector 108 equalizes pressure with the ambient well pressure, to keep well fluid debris from entering the interior of the protector 108.

The protector 108 may include many types of sensors to monitor and improve operation, to keep the protector 108 healthy, and to provide high reliability. The protector 108 may include a fiber optic strand 416 to sense distributed temperatures. The fiber optic strand 416 may be the same fiber optic strand 416 running continuously through much or all of the ESP string 100. The protector 108 may also include, e.g., for each bearing, a temperature sensor 328 and a vibration sensor 336. The bag or bellows chamber 408 may have associated differential pressure sensors 412 to measure, for comparison, pressure inside and outside of the bag or bellows chamber 408. A protection mechanism for a protector string employs differential pressure sensors 412 to measure pressure inside and outside the bag or bellows 408 of the protector 108. When a mechanical valve is not protecting the bag or bellows chamber 408, for excessive pressure, the protector 108 may include an electrical pressure relief valve 414 to relieve excess pressure on a signal from a surface sensor analyzer, or from a local logic circuit. The electrical relief valve 414 may be used in tandem with conventional mechanical relief valves. Differential pressure sensors 412 monitor stress on the bag, bellows 408, accordion, or other means for equalizing pressure between, e.g., motor oil and external reservoir fluid. When pressure builds up due to a mechanical relief valve failure, the event is detected by differential pressure sensors 412, and the electrical relief valve 414 operates to relieve pressure and prevent protector bag failure or bellows 408 failure.

Figure 5:
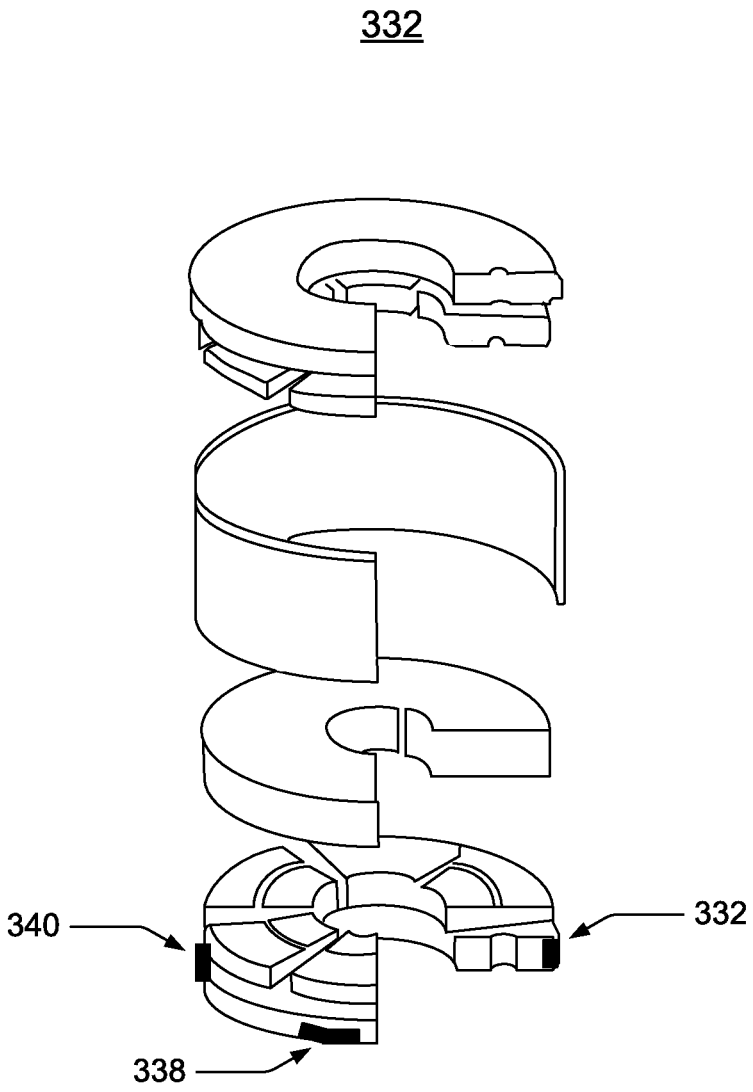
FIG. 5 is a diagram of an example ESP thrust bearing section, including sensors that can be used with event-based telemetry.

FIG. 5 shows an exploded view of an example ESP thrust bearing ESP section (e.g., 322 or 406). The thrust bearing 322 may be instrumented by addition of at least one temperature sensor 332, a strain sensor 338 (e.g., a load cell), and a proximity sensor 340, to monitor status. The example proximity sensor 340 has high reliability and long functional life because of an absence of mechanical parts in the proximity sensor 340 and lack of physical contact between the proximity sensor 340 and the sensed bearing or shaft. A suitable proximity sensor 340 can measure the variation in distance between the shaft and its support bearing, or between friction interface surfaces of the thrust member 322.

Figure 6:
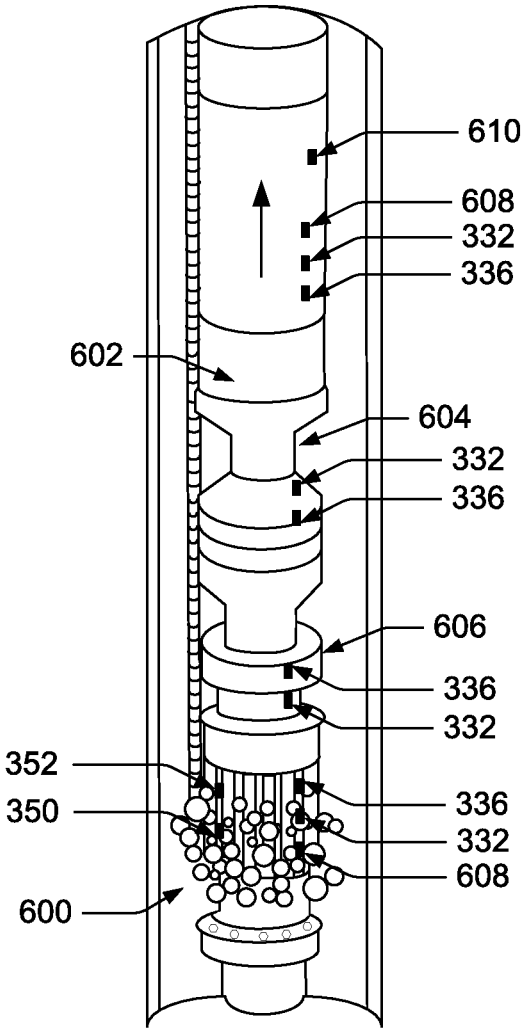
FIG. 6 is a diagram of an example ESP pump section, including sensors that can be used with event-based telemetry.

FIG. 6 shows an example ESP pump 104 and associated intake 600. The ESP pump 104 may be a centrifugal pump, but in alternative implementations the example pump 104 may be another type of submersible pump, such as a diaphragm pump or a progressing cavity pump in another type of submersible pump string setup. The example pump 104 has a fluid inlet or intake 600, and a fluid discharge 602. The example pump 104 may have various bearings, such as bearing 604 and bearing 606. Each bearing 604 & 606 may have an associated temperature sensor 332 and vibration sensor 336. The fluid intake 600 may also have at least one pressure sensor 608, a temperature sensor 332, and a vibration sensor 336. Likewise, the fluid discharge 602 may have a respective pressure sensor 608, temperature sensor 332, and vibration sensor 336. The pump 22 may have at least one associated flow sensor 610 to determine a current flow rate of the pump 104 or other volumetric fluid data. The pump 104 may also have associated at least one chemical sensor 350 and at least one water cut sensor 352. These sensors 350 & 352 can detect a gas-oil ratio, solids content, $H_2S$ and $CO_2$ concentrations, pH, fluid density, and fluid viscosity, for example. The output of the various sensors of the pump 104 may be multiplexed to communicate with the surface using a minimum of communication wires, or a single fiber optic cable.

FIG. 7 shows the example event table 114 of FIGS. 1-2 in greater detail. The illustrated event table 114 is only one example table 114 containing example parameter ranges, for the sake of description. Current sensor values are shown as boxed in FIG. 7, and shown within their corresponding upper and lower ranges of allowed values. When a real time sensor datum falls outside a relevant parameter range in the example event table 114, a triggering event is deemed to have occurred in the well or the ESP 100. The event table 114 thus includes threshold values for various sensor data corresponding to the occurrence of an event to be monitored with priority. The event table 114 may be stored locally, in communication with a downhole implementation of the telemetry management module 112. Updates to the event table 114 may be uploaded to the telemetry management module 112 from the control and monitoring system 118, located at the surface, for example.

The example telemetry management module 112 may continuously process signals from the various downhole sensors 110 of the ESP system 100 in real time, comparing the collected sensor data against the event table 114. When the control and monitoring system 118 provides closed-loop feedback control of various operating parameters associated with the ESP 100 during operation, including obtaining sensor readings via telemetry, the information used in the closed-loop control processes may also be utilized by the example telemetry management module 112 to detect the triggering events as defined in the example event table 114.

Figure 8:
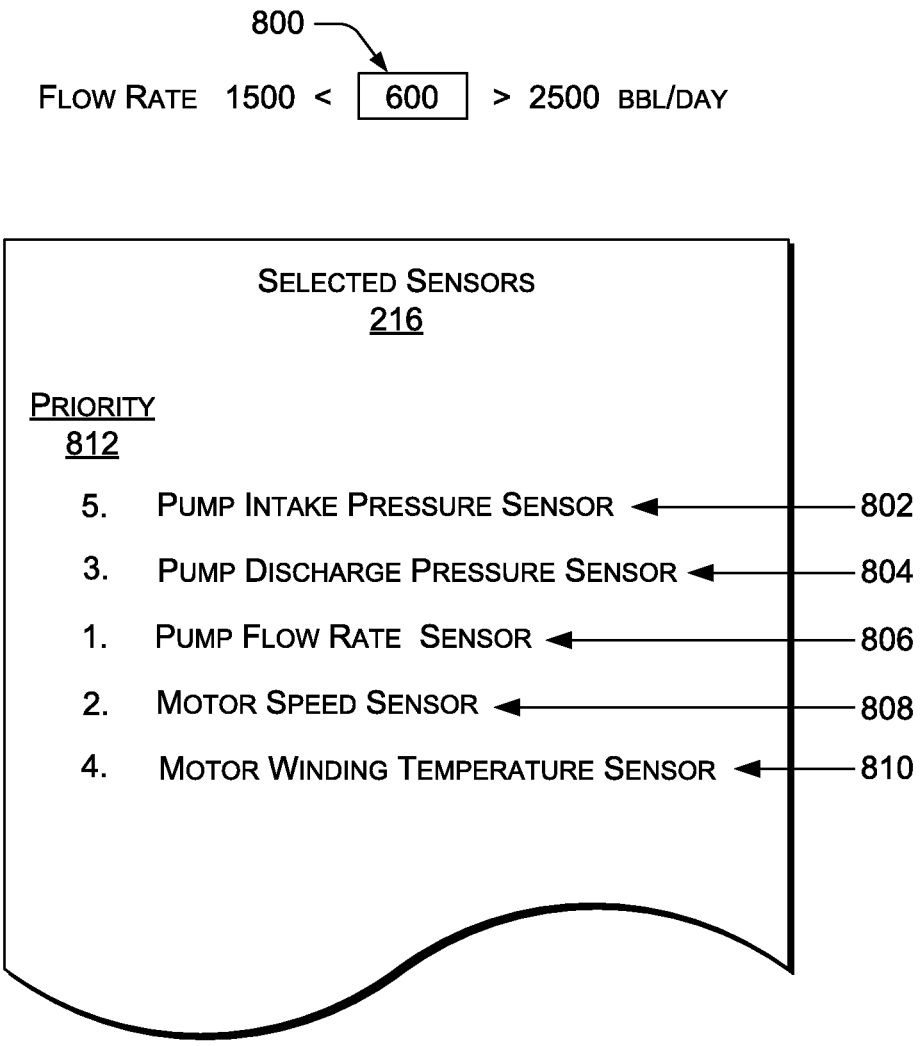
FIG. 8 is a diagram of selected sensors coordinated to address the occurrence of a triggering event in an ESP string.

FIG. 8 shows an example selection of sensors 216 to address a specific triggering event. In an implementation, the polling engine 204 of the example telemetry management module 112 sends routine sensor data to the trigger module 210. When the trigger module 210 compares a sensor datum with a relevant parameter range in the event table 114 and detects the sensor datum to be out of range, then the trigger module 210 sends the sensor datum to the priority engine 212 for immediate transmission to the control and monitoring system 118. For example, if there is a sensed change in flow rate of significant value, a frame of data corresponding to the current flow rate reading can be sent immediately, rather than with latency, and data may be sent relatively continuously for a defined time period, to the control and monitoring system 118 at the surface so that the flow rate can be more accurately controlled. The trigger module 210 may also send the identity of the triggering event to the sensor coordinator 214. The sensor coordinator 214 may generate a list of selected sensors 216, such as those shown in FIG. 8, in response to a low flow rate value 800 that has triggered a flow rate event to be monitored.

In this flow rate example, the sensor coordinator 214 chooses five sensors to address the flow rate triggering event: a pump intake pressure sensor 802, a pump discharge pressure sensor 804, a pump flow rate sensor 806, a motor speed sensor 808, and a motor winding temperature sensor 810. This list of selected sensors 216 is an example. The sensor coordinator 214 then prioritizes the selected sensors 216 according to the importance and relevance of the data that each sensor will produce with respect to the triggering event of a low flow rate, and assigns priority 812.

When priority 812 has been assigned to selected sensors 216 associated with a triggering event, then in an implementation, the acquisition frequency module 218 determines how frequently each sensor will be sampled by the polling engine 204. The frequency of data acquisition can range from almost continuously, to relatively infrequently for parameters that do not change very quickly.

In an implementation, the telemetry management module 112 may also adopt a single-event-single-signal approach, in which an event is monitored with regard to only one operating parameter and signals related thereto. Or, as described above, the example telemetry management module 112 may also incorporate multiple event, multiple signal approaches in which multiple events relating to multiple operating parameters and signals are monitored. This approach correlates changes in one operating parameter with changes in other operating parameters that may occur simultaneously or close in time. Thus, the response of an event to a change in a control signal can be seen without the latency disadvantages of conventional systems.

Figure 9:
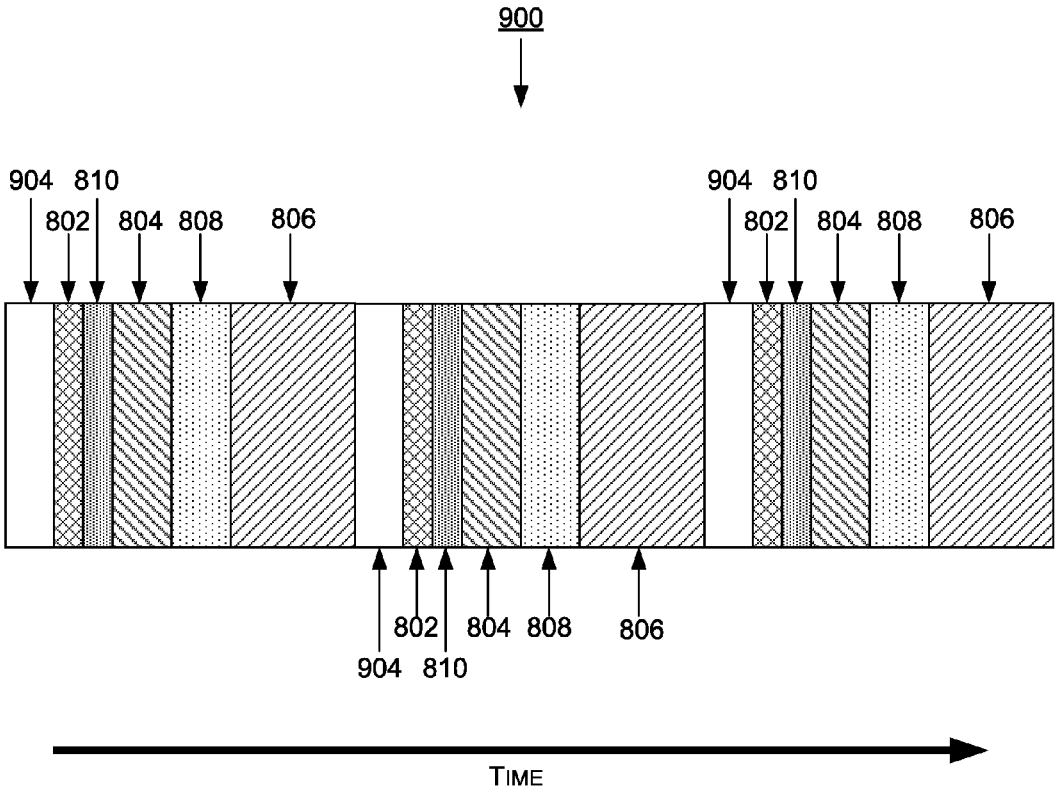
FIG. 9 is a diagram of an example data stream assembled to give priority and increased bandwidth to sensor data addressing a triggering event in a well.

FIG. 9 shows an example data stream 900, as assembled by the sensor data multiplexer 220. The illustrated data stream 900 is only an example representation, shown as time-division signal multiplexing. The sensor data multiplexer 220 may also use space or frequency multiplexing. The transmission prioritizer 222 and the transmission bandwidth module 226 assign a data throughput to each selected sensor 216 depending on the priority 812 assigned to the sensor and the type of parameter the sensor monitors. The reporting frequency module 228 may also participate in determining throughput for the data of a given sensor. The sensor data multiplexer 220 then assembles the data stream 900 according to the bandwidths and reporting frequencies assigned to the data received from each selected sensor 216.

In FIG. 9, the time windows allotted to the data from each selected sensor 216 are represented in the data stream 900. For example, the sensor with the highest priority, i.e., the pump flow rate sensor 806, is assigned the highest bandwidth in the data stream 900, and therefore the widest time window. During transmission, the data stream 900 may repeat the sequence of assembled sensor data over and over, each time with newest sensor readings sent. For example, the sequence of prioritized data repeats three times in the illustrated example data stream 900 in FIG. 9. Each selected sensor 216 is represented in time transmission time windows 806, 808, 804, 810, and 802. An additional time window 904 with assigned bandwidth may be reserved for transmitting the data of other sensors that are routinely monitored, but not urgent to the current triggering event. Transmission of data from the selected sensors 216 thus assembled may continue repetitively, until the trigger module 210 or another intervention calls off the triggering event. For example, the telemetry management module 112 may return to routine sensor polling after a default period of time. Or, the data being polled by the selected sensors 216, which triggered the event to be monitored in the first place, may return to normal values, which may return the telemetry management module 112 to routine polling of the sensors 110.

Figure 10:
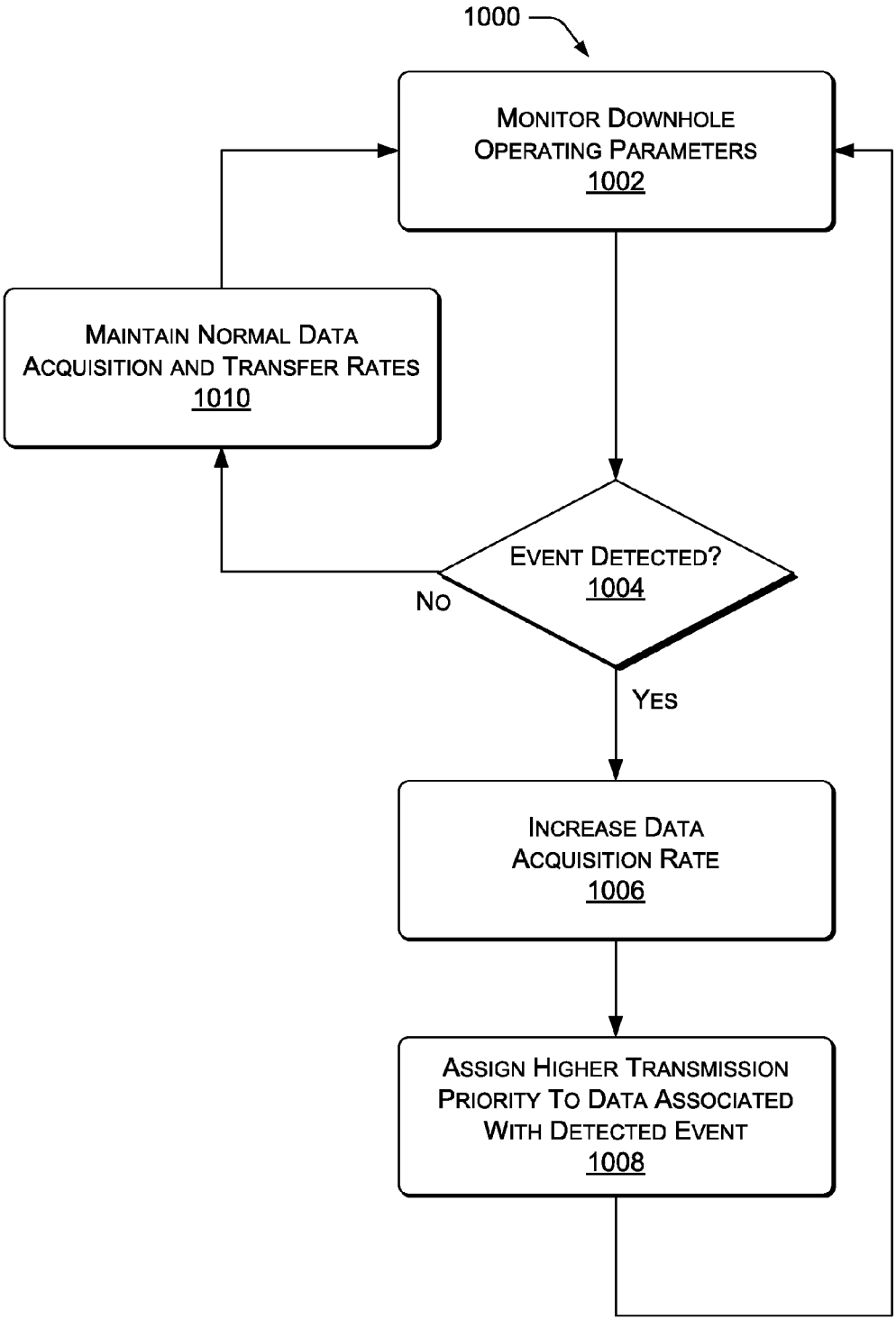
FIG. 10 is a flow diagram of an example method of performing event-based telemetry for artificial lift in a well.

FIG. 10 shows an example method 1000 for performing event-based telemetry for artificial lift in wells. The operations are shown as individual blocks. The example method 1000 may be performed by hardware, such as the example telemetry management module 112.

At block 1002, downhole operating parameters, such as temperature, flow, and pressure are monitored.

At block 1004, a determination is made as to whether or not a triggering event has occurred. If not, then at block 1010, continues to maintain the normal data acquisition rates and transmission priorities for the operating parameters being monitored. If, on the other hand, a triggering event has occurred, then at block 1006, the rate of data acquisition for one or more sensors corresponding to the event may be increased.

At block 1008, a higher transmission priority is assigned to the data associated with the detected triggering event. For example, higher transmission priority may take the form of transmitting the data in real time, and/or continuously if bandwidth allows, or increasing the bandwidth allotted in relation to the priority of the data. The system may then return to block 1002.

Conclusion

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The invention claimed is:

1. A method, comprising:

in a closed-loop control system, controlling power to an electric submersible pump in a well wherein the electric submersible pump comprises sensors that acquire data, a telemetry link for transmission of acquired data to a controller according to corresponding transmission priorities, and event information;

in the electrical submersible pump, detecting a triggering event based on at least a portion of the event information, information utilized in a closed-loop control process, and at least a portion of acquired data;

in the electrical submersible pump, based at least in part on the detected triggering event, selecting at least one of the sensors and increasing the transmission priority for the selected at least one of the sensors;

receiving by the controller, data acquired by the selected at least one of the sensors; and during the receiving, via the controller, controlling the power supplied to the electrical submersible pump according to the closed-loop control process based on at least a portion of the data acquired by the selected at least one of the sensors.

2. A system, comprising:

an electric submersible pump that comprises sensors associated that acquire data related to well parameters;

a controller that implements a closed-loop control process that controls power to the electric submersible pump based at least in part on at least one of the well parameters;

a polling engine that gathers data from the sensors at intervals;

a database for identifying a triggering event associated with the well based on at least a portion of the data and information utilized by the closed-loop control process; and a priority engine that transmits data to the controller wherein the data are related to the triggering event and transmitted with a higher priority than data not related to the triggering event.

3. The system of claim 2, wherein the database comprises threshold values for respective sensors; and wherein when a datum from a sensor exceeds one of the threshold values, a respective triggering event is identified as having occurred.

4. The system of claim 2, wherein the database comprises logical conditions between the data from the sensors; and wherein when a logical condition is fulfilled based on the data, a respective triggering event is identified as having occurred.

5. The system of claim 2, further comprising a sensor coordinator for selecting a set of the sensors to be correlated with the triggering event.

6. The system of claim 5, wherein the priority engine communicates to the polling engine an acquisition frequency for each sensor in the set of sensors based on the triggering event.

7. The system of claim 5, further comprising a transmission prioritizer for assigning a priority and a corresponding transmission bandwidth to data from each sensor in the set of sensors correlated with the triggering event.

8. The system of claim 7, wherein the transmission prioritizer determines a reporting frequency for transmitting the data from each sensor in the set of sensors.

9. The system of claim 7, further comprising a multiplexer to assemble a data stream of the data from each sensor in the set of sensors associated with the triggering event; and wherein the multiplexer assembles the data stream according to the priority and the transmission bandwidth assigned to the data from each sensor in the set of sensors associated with the triggering event for transmission over a limited bandwidth transmitter.

10. The method of claim 1 wherein controlling power to the electric submersible pump comprises controlling a variable speed drive.

11. The method of claim 1 wherein controlling power to the electric submersible pump comprises supplying power via a power cable operatively coupled to the electric submersible pump and wherein the transmission link is operatively coupled to the power cable for transmitting data acquired by the selected at least one of the sensors to the controller.

12. The method of claim 1 wherein the selecting at least one of the sensors comprises selecting at least one motor sensor for an electric motor of the electric submersible pump.

13. The method of claim 1 wherein the selecting at least one of the sensors comprises selecting at least one pressure sensor.

14. The method of claim 1 wherein the selecting at least one of the sensors comprises selecting at least one flow rate sensor.

15. The method of claim 1 wherein the electric submersible pump comprises a multi-sensor gauge that comprises at least two of the sensors.

16. The method of claim 1 wherein the triggering event comprises a flow rate event and wherein the selecting at least one of the sensors comprises selecting a plurality of the sensors.

17. The method of claim 16 wherein the plurality of the sensors comprise at least a pressure sensor and a flow rate sensor.

18. The method of claim 16 wherein the plurality of the sensors comprise at least one motor sensor.

19. The method of claim 1 wherein the selecting comprises selecting a plurality of the sensors and wherein the increasing the transmission priority comprises prioritizing the selected sensors according to relevance of data that each sensor will produce with respect to the triggering event.

* * * * *